United States Patent [19]

Pope

[11] 3,963,033

[45] June 15, 1976

[54] ELECTRONIC SMOKING INHIBITING DEVICE

[76] Inventor: John W. Pope, P.O. Box 45246, Dallas, Tex. 75235

[22] Filed: May 28, 1975

[21] Appl. No.: 581,633

[52] U.S. Cl. ..... 131/170 A
[51] Int. Cl.[2] ..... A24F 15/06
[58] Field of Search ..... 131/170 A, 8 A; 35/22 R; 128/409

[56] References Cited

UNITED STATES PATENTS

| | | | |
|---|---|---|---|
| 3,655,325 | 4/1972 | Toppel | 35/22 R X |
| 3,885,576 | 5/1975 | Symmes | 35/22 R X |
| 3,886,953 | 6/1975 | Pope | 35/22 R X |
| 3,889,163 | 6/1975 | Symmes | 131/170 A X |

*Primary Examiner*—Louis G. Mancene
*Assistant Examiner*—Wenceslao J. Contreras
*Attorney, Agent, or Firm*—Mason, Fenwick & Lawrence

[57] ABSTRACT

A compact portable battery powered cigarette smoking inhibiting device having a cigarette storage compartment covered by a movable lid controlled by a releasable latch. An electronic smoking inhibiting circuit means is provided in the case for the device which includes an electrical delay means for establishing a predetermined delay period following actuation of the latch, and a sound producing alarm device and a faradic shock generator operated at the end of the delay period for generating an alarm sound and then apply a faradic shock to the user.

8 Claims, 4 Drawing Figures

ELECTRONIC SMOKING INHIBITING DEVICE

This application discloses and claims only subject matter disclosed in my application Ser. No. 468,380 filed May 9, 1974.

BACKGROUND AND OBJECTS OF THE INVENTION

The present invention relates in general to cigarette smoking inhibiting devices, and more particularly to small portable battery powered electronic devices for systematically inhibiting the behavior of cigarette smoking by administering faradic shock punishment and thereby inhibiting smoking by aversion therapy.

Following the release of the Surgeon General's Report in 1964 concerning the dangers of cigarette smoking, there has been much research conducted regarding the development of methods to extinguish cigarette smoking behavior. Various methods have been employed or suggested for inhibiting cigarette smoking or extinguishing cigarette smoking behavior, ranging from psychotherapy to various forms of behavior therapy. Within the area of types of theraby previously considered, there has been interest in electrical shock paired with smoking behavior. This is variously referred to as aversive therapy, electrotherapy, noxious stimulus presentation, and faradic shock punishment.

The currently used electric shock punishment method of treatment of smoking behavior is subject to a number of disadvantages as currently used. Treatment must be conducted within a clinical or experimental setting; it is only received on a scheduled basis, usually bi-weekly; treatment is limited within the experimental settings to only those individuals selected for an experiment, and is limited within the clinical setting to only those individuals who can economically afford such treatment; and as a practical measure such treatment is limited to urban areas. Antismoking clinics are few, and treatment by this method necessitates the use of large machines, and someone to administer the faradic shock punishment techniques.

As presently administered, the faradic shock punishment treatment most often consists of the sequence of (a) attaching electrodes to the patient's arms, hand, finger, etc., (b) adjusting the faradic shock instrument to a varying degree to establish the milliamperage to be dispensed, (c) testing the machine, (d) having the patient begin to smoke cigarettes, and (e) administering the faradic shock treatment while the patient is actually smoking. This treatment is limited in effectiveness in that punishment is only received within the clinic and no opportunity is given to avoid the punishment. Thus within the clinical or experimental setting, the individual cannot escape the electrical shock by refraining from the use of cigarettes. Nor does the frequency of administration of the shock treatment throughout any 24 hour period bear relation to the cigarette smoking frequency during that period. For these and other reasons, the methods previously suggested do not provide controlled and effective therapy for the general public.

An object of the present invention is the provision of a portable, battery operated case serving as a holder for a pack of cigarettes from which the cigarettes are dispensed by the user, together with an electrode or electrodes placed on the smoker's preferred smoking hand, finger or arm for administering a shock to the user after a selected delay period following manipulation of the device to dispense a cigarette. Means are provided for the user to open the device to obtain a cigarette and electronic circuits are provided to perform certain operational sequences including emission of an alarm sound to achieve certain conditioning in connection with the sequence of operation.

The subject smoking inhibiting device avoids the limitation of treatment to clinical or experimental settings, the treatment is automatically dispensed in relation to the cigarette smoking frequency throughout a 24 hour period, the treatment is available at minimal cost, and is available to all smokers regardless of geographic location. It is not contingent on administration of the treatment by a professional, there is no necessity to predetermine shock intensity or skin resistance, the duration of punishment is uniform and preset to occur in a fixed ratio following inception of smoking behavior, the electrode band placement may be on the preferred smoking arm or the index finger of the preferred smoking arm, and the device, due to its portability, can be carried at all times where smoking frequency occurs, with the assurance of automatically controlled therapy.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
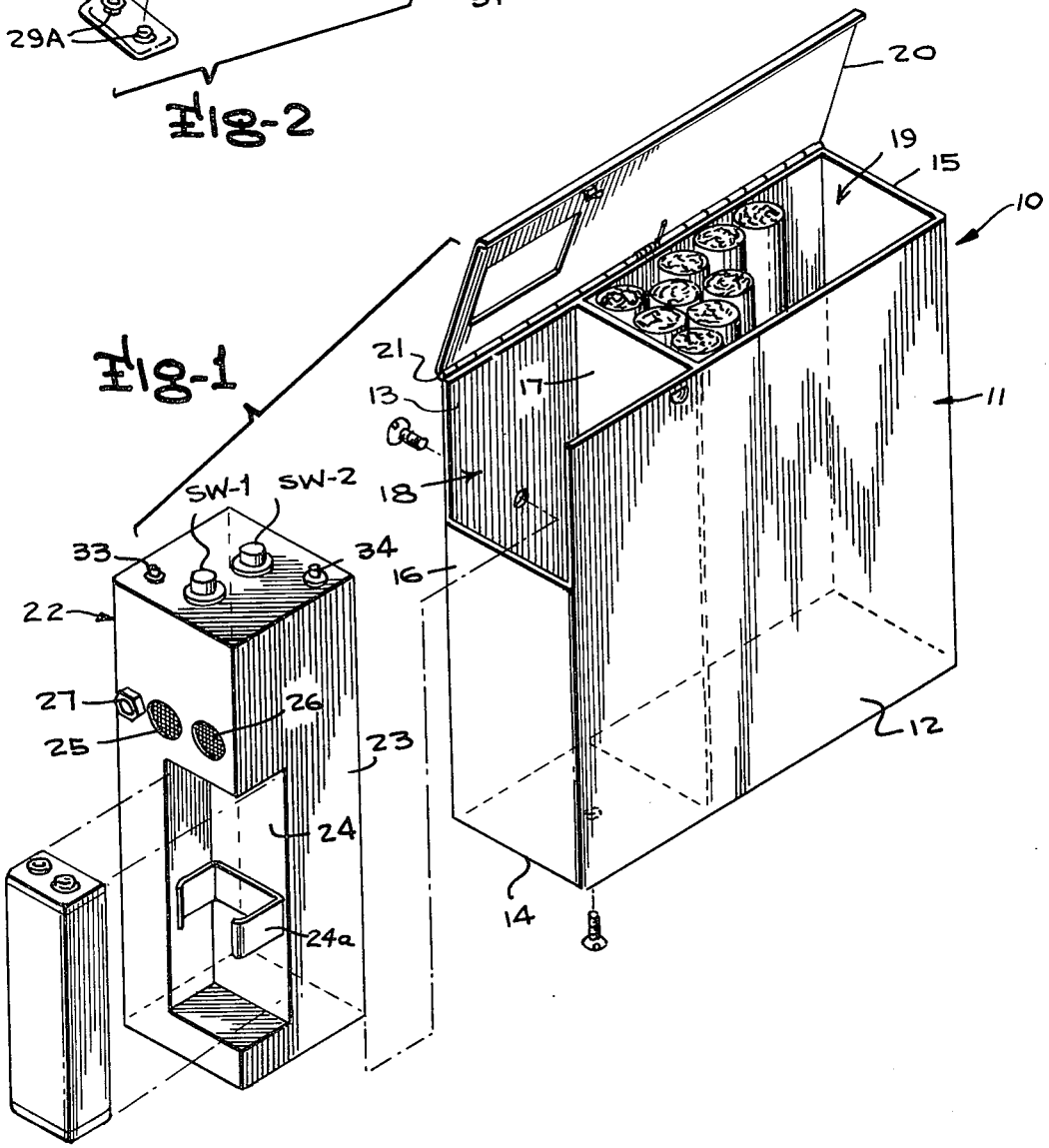
FIG. 1 is an exploded perspective view of a cigarette case including smoking inhibiting device, with the smoking inhibiting components formed in a module shown separated from the case.

Referring to the drawings, wherein like reference characters designate corresponding parts throughout the several figures, the cigarette case and smoking inhibiting device of the present invention is indicated generally by the reference character 10 and, in one preferred form, comprises a case 11 of generally rectangular, box like configuration having front and rear walls 12, 13, a bottom wall 14, a full end wall 15, and a partial end wall 16. An intermediate partition 17 paralleling the end wall 15 but spaced a selected distance between the full end wall 15 and partial end wall 16, defines a module compartment 18 extending the full height of the case and open at the top and along the upper portion of the outer end between partition 17 and partial end wall 16, and defines a cigarette storage compartment 19 between the partition 17 and end wall 15 which is open at the top of the case. The cigarette storage compartment 19 and module compartment 18 are covered at the top by a hinged top or cover 20, which in the illustrated example, is hinged along the entire length of the top edge of rear wall 13 by a spring loaded hinge 21 biasing the hinged top or cover 20 to the open position. The partial end wall 16 at the left-hand end of the case, as viewed in FIG. 1, extends upwardly from the bottom wall 14 to a level spaced a selected distance below the top of the case so that the upper region of the module compartment 18 is open to the left of the case, as viewed in FIG. 1.

The smoking inhibiting components are formed into a smoking inhibiting module unit 22 adapted to be removably housed in the module compartment 18, and comprising a module casing 23 having a well formed therein, indicated at 24, for removably receiving a battery, such as a 30-volt transistor battery, and having a spring holding clip, as indicated at 24*a*, for releasably holding the battery in the well or compartment 24. The height of the battery compartment or well 24 is so correlated to the height of the partial end wall 16 that the partial end wall covers the battery compartment and the battery therein when the module is fully seated in the module compartment 18. The electronic components of the module, forming the smoking inhibiting components of the device, are housed in the module unit casing 23, and, in the preferred embodiment, two manually operable push-buttons, indicated at SW-1 and SW-2 project from the top of the module casing 23 and through a suitable opening or cut-out formed in the hinged top or cover 20. Also projecting from the top of the module unit casing 23 are a micro-switch actuator pin or rod 33 and a solenoid plunger 34, for purposes to be later described.

Figure 2:
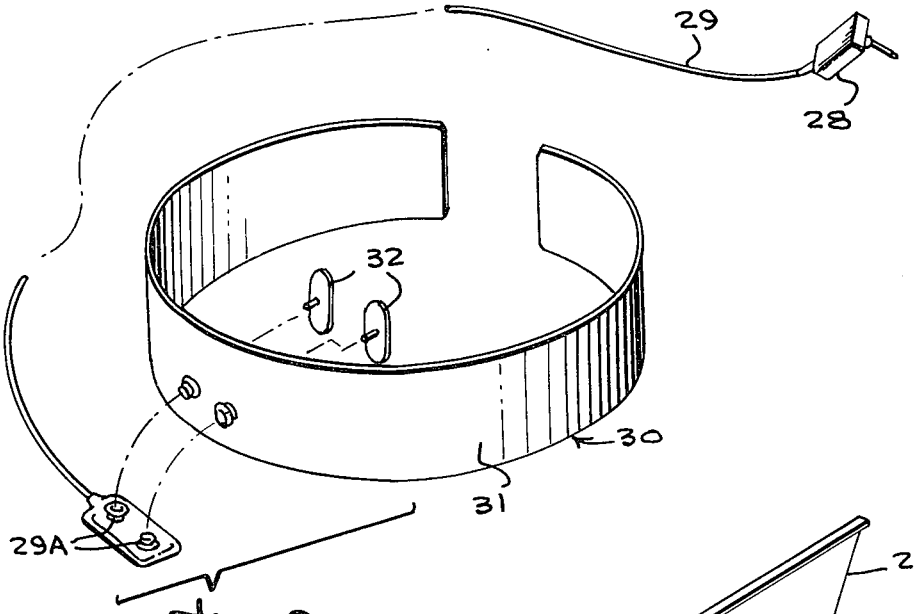
FIG. 2 is an exploded perspective view of a typical faradic shock arm band and snap connector type leads to a jack, usable with the smoking inhibiting device of the present invention.

In the preferred embodiment, the upper end wall portion of the module 22 disposed immediately above the partial end wall 16 includes a miniature buzzer 25 and a tone generator 26 which are exposed above the partial end wall 16 to produce audible sounds. Also a female plug 27 is disposed in this portion of the module casing to receive a male jack 28 connected by flexible conductors or leads 29 to faradic shock arm band 30, illustrated in FIG. 2, by which electric shocks are applied as punishment to the arm of the user or subject in accordance with the present invention, from the electronics in the module unit 22. The typical arm band 30 may comprise a 16-gauge spring steel metallic band covered, for example, with dielectric rated heat shrinkable plastic, curved to releasably fit over and be held on the arm of the user. The steel band 31 supports copper contact pads 32 which may be silver-plated, electrically interconnected pads secured on the steel band 31 and electrically connected to a pair of conventional electric snap connectors mating with similar snap connectors 29A to permit the electrical leads connected to the jack 28 to be releasably de-coupled from the arm band. If desired, of course, the electrical leads may be permanently attached to the arm band. Also, if desired, a finger band of similar construction to the arm band but sized to releasably fit on the finger of the user may be used instead of the arm band.

Figure 3:
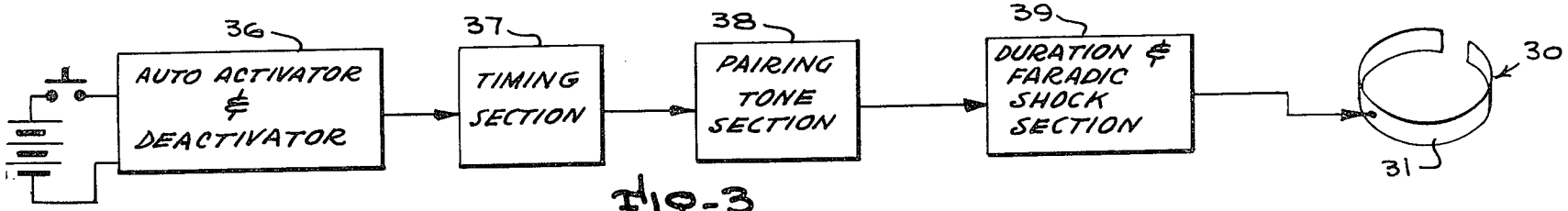
FIG. 3 is a block diagram of the electronic components forming the smoking inhibiting device.

A block diagram of the electronic system incorporated in the module to activate the buzzer 25 to produce an audible sound upon manual activation of the device to open the lid or cover 19 and to apply faradic shock punishment to the user, by the arm band or finger band, if the unit is not manually deactivated within a selected delay period before the lid opens, is illustrated in FIG. 3 and comprises, as the major stages thereof, an Autoactivator and Deactivator Section 36, a Timing Section 37, a Pairing Tone Section 38, and a Duration and Faradic Shock Section 39.

Figure 4:
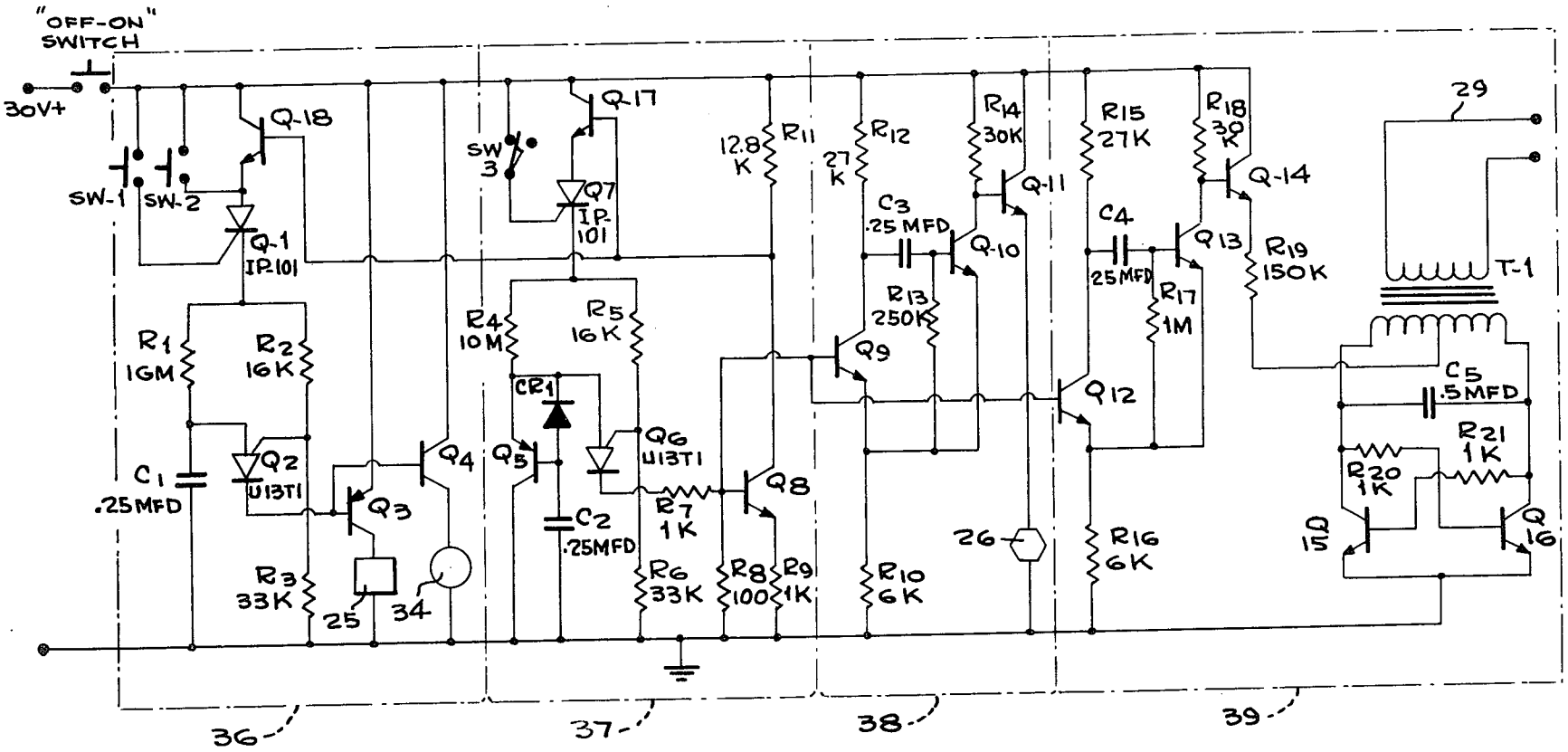
FIG. 4 is a schematic diagram of the electronic circuit for the smoking inhibiting portion of the device.

The schematic circuit for a preferred embodiment of the smoke inhibiting device electronics is illustrated in FIG. 4, with representative values for the circuit elements being indicated in the drawing. Referring to the schematic diagram of FIG. 4, it will be noted that the main on-off switch, which for convenience may be incorporated in the plug structure 27 to be closed by the jack 28 when the jack is inserted in plug 27, controls the application of the positive 30-volt supply from the battery to the electronic circuit components. The DEACTIVATE button switch SW-2 is connected across the transistor Q-18 and the CYCLE INITIATE push-button switch S-1 is connected to the gate of silicon control switch (or SCR) Q-1, as shown. To initiate the cycle of operation, assuming the OFF-ON switch is closed or ON, the CYCLE INITIATE push-button switch SW-1 is depressed manually, which caused the SCR Q-1 to conduct and places a positive pulse through resistors R-1 and R-2 to cause SCR Q-2 and transistor Q-3 to conduct. Conduction through Q-2 causes the buzzer 25 to sound for a period of 10 seconds. SCR Q-1, once energized by momentary closure of the CYCLE INITIATE switch SW-1, serves as a "seal-in" device for the momentarily closed contacts of the CYCLE INITIATE switch SW-1. The resistors R-1, R-2, and R-3 form a bias circuit in conjunction with the capacitor C-1, which requires ten seconds to charge and fire, thus causing a positive pulse which switches SCR Q-2 off. When SCR Q-2 is thus turned off the buzzer 25 is deactivated, and transistor Q-3 is simultaneously turned on for the duration of the pulse, to energize the solenoid plunger 34 and release the spring loaded hinged lid or cover 20 which opens, allowing the subject or user to obtain a cigarette from the cigarette storage compartment, after which he manually closes the cover or lid. For pairing response purposes, the subject may deactivate the entire circuit operation by depressing the DEACTIVATE switch SW-2, which turns off SCR Q-1 and as a result removes power from the circuit, if the DEACTIVATE switch SW-2 is depressed prior to completion of ten second time period, determined by R-1, R-2, R-3 and C-1, when the buzzer 25 is in the on or activated condition.

When the lid or cover 20 is opened following the ten second delay period and tripping of the lid latch formed by the plunger of the solenoid 34, the micro switch SW-3 which bears against the lid is automatically tripped by the movement of the micro switch actuator 33 which occurs upon opening of the lid. The tripping of micro switch SW-3 causes SCR Q-7 to conduct, which serves to seal-in the circuit after the momentary activation by switch SW-3. When SCR Q-7 conducts, voltage is applied to a timing circuit comprising resistors R-4, R-5, R-6, transistor Q-5, and capacitor C-2 in combination, which serve to bias SCR Q-6 to keep it in a non-conducting state for a period of two minutes, at which time capacitor C-2 becomes fully charged and fires, applying a positive pulse to SCR Q-6 to turn Q-6 on. Diode CR-1 serves to block a charge path from R-4 and forces a timed charge rate through transistor Q-5.

When the SCR Q-6 of the Timing Section 37 is thus pulsed ON, voltage is switched through transistor Q-8, causing transistors Q-9 and Q-12 to be energized. Transistor Q-10 is biased with resistors R-10 and R-12, causing transistor Q-11 to conduct and energize the tone generator 26. Capacitor C-3 is allowed to charge in conjunction with resistors R-13, R-14 and transistor Q-10, establishing a charge rate of five seconds to charge and fire capacitor C-3, switching transistors Q-10 and Q-11 off and thereby de-energizing the tone generator 26 after the five second period.

The voltage switched through transistor Q-8 when SCR Q-6 was pulsed ON also energized transistor Q-12 in the Duration and Faradic Shock Section 39, having a circuit including resistors R-15, R-16, R-17, R-18, capacitor C-4 and transistors Q-13 and Q-14 which function the same as the similar circuits in the Pairing Tone Section 38, except that capacitor C-4 requires 70 milliseconds to discharge and thereby fixes the duration of the shock to be applied to the patient. A shock of 4 milliamperes at 600 volts is applied through the conductor leads 29 to the subject when the transistor Q-14 is switched on and applies voltage through resistor R-19 to the oscillator circuit comprising transistors Q-15 and Q-16, resistors R-20 and R-21, and capacitor C-5, converting the direct current 30-volt supply from the battery to a 30-volt AC voltage which is applied to the step-up transformer T-1 having a winding ratio appropriate to produce a 600-volt peak-to-peak 4 milliamperes shock signal. The faradic shock of 4 milliamperes at 600 volts is applied for a duration of 70 milliseconds through the arm band 30 or similar finger band connected to the subject with a galvanic skin resistance of 250K to 500K ohms.

Following energizing of transistors Q-9 and Q-12, initiating the switching on of transistors Q-11 and Q-14 in the Tone Pairing Section 38 and Faradic Shock Section 39, transistors Q-17 and Q-18 are de-energized, dropping the seal-in circuits of SCR's Q-1 and Q-7 to clear the circuit for another complete cycle.

It will be apparent from this description that in the normal use of the cigarette case and smoking inhibiting device of the present invention, the subject will normally depress the CYCLE INITIATE button SW-1 to commence an automatic cycle which results in the automatic opening of the lid 20 by energization of the lid opening solenoid 34 after a 10 second delay period. Immediately upon depression of the CYCLE INITIATE button SW-1, the buzzer 25 is energized, producing an audible sound indicating to the subject that the automatic lid opening cycle is being timed out for the ten second delay period and that he will be subjected to faradic shock punishment five seconds after the lid is open if he does not terminate the lid opening cycle before the end of the ten second period. The subject has the option of deciding within the ten second period to deactivate the entire circuit, by depressing the DEACTIVATE button SW-2 before completion of the ten second period, so that the lid or cover is not released to provide access to the cigarettes and the faradic shock punishment is avoided. If the DEACTIVATE button SW-2 is not depressed during the ten second delay period during which the buzzer 25 is sounding, the electronic circuit automatically activates the solenoid 34 to retract its plunger and automatically open the lid 20, which allows the micro switch actuator 33 to rise and close the micro switch SW-3. The closure of the micro switch SW-3 senses the fact that the lid is opened and conditions the circuit so that delayed faradic shock punishment is unavoidable even if the lid is closed shortly after activation of the micro switch. Closure of the micro switch SW-3 immediately commences the five second tone produced by the tone generator 26, and at the conclusion of this five second delay period, the circuit immediately delivers the faradic shock punishment through the plug 27, jack 28 and leads 29 to the arm band 30 or finger band.

Variations of the above may be provided, as, for example, by removing or omitting the arm band jack 28 and substituting a dummy jack, thus eliminating the faradic shock punishment feature. With such a modified system, opening of the lid results in only the tone being produced by the tone generator 26 without producing the faradic shock punishment, preceded by the initial presentation of the noise of the buzzer 25 for the ten second delay period.

Obviously, a manually releasable lid latch may be provided, rather than employing a CYCLE INITIATE switch and circuitry for energizing a lid opening solenoid, to permit the lid to be opened manually by depressing the manually releasable latch, and/or the buzzer 25 and associated circuitry as well as the latch opening solenoid circuitry may be eliminated, so that only the delayed faradic shock punishment, with or without the tone generator sound, would be the features retained.

I claim:

1. Apparatus for inhibiting cigarette smoking, comprising a cigarette case having a cigarette storage compartment, a movable lid normally closing said compartment and movable to an open position permitting access to the compartment for removal of a cigarette, smoking inhibiting means carried by the case administering faradic shock punishment to a user person operating the case under predetermined conditions comprising an electronic circuit housed in said cigarette case including an electrical faradic shock generator for producing a faradic shock electrical signal and an electrical delay means activated upon opening of the lid to establish a predetermined post-opening delay period following opening of said lid and activate said faradic shock generator to produce said faradic shock electrical signal at the end of said delay period, and an electrically conductive shock applying device to be conductively connected to said shock generator and to be supported in contact with the skin of the user for applying the faradic shock signal to the user to produce the shock punishment.

2. Apparatus as defined in claim 1, including an auditory signal generator in said cigarette case activated by said delay means a predetermined short time before activation of said faradic shock generator to emit an audible warning sound shortly before the shock signal is applied to the shock applying device.

3. Apparatus as defined in claim 1, wherein the means for activating the delay means upon opening of the lid comprises a switch member having an actuator resiliently biased into contact with the lid and held in switch-opening position when the lid is closed, and said delay means including an electronic delay circuit for timing out the post-opening delay period responsive to closing of said switch member upon opening of the lid.

4. Apparatus as defined in claim 2, wherein the means for activating the delay means upon opening of the lid comprises a switch member having an actuator resiliently biased into contact with the lid and held in switch-opening position when the lid is closed, and said delay means including an electronic delay circuit for timing out the post-opening delay period responsive to closing of said switch member upon opening of the lid.

5. Apparatus as defined in claim 1, wherein said shock applying device comprises a flexible band member for partially encircling and gripping a limb portion of the human body to retain the band member in selected position thereon, an electrically conductive metallic contact pad formation carried by the band member to be held thereby in contact with the skin of the user, and flexible electrical conductors coupled to an extending from the pad formation for releasable connection with the shock generator carried by the case.

6. Apparatus as defined in claim 2, wherein said shock applying device comprises a flexible band member for partially encircling and gripping a limb portion of the human body to retain the band member in selected position thereon, an electrically conductive metallic contact pad formation carried by the band member to be held thereby in contact with the skin of the user, and flexible electrical conductors coupled to an extending from the pad formation for releasable connection with the shock generator carried by the case.

7. Apparatus as defined in claim 3, wherein said shock applying device comprises a flexible band member for partially encircling and gripping a limb portion of the human body to retain the band member in selected position thereon, an electrically conductive metallic contact pad formation carried by the band member to be held thereby in contact with the skin of the user, and flexible electrical conductors coupled to and extending from the pad formation for releasable connection with the shock generator carried by the case.

8. Apparatus as defined in claim 4, wherein said shock applying device comprises a flexible band member for partially encircling and gripping a limp portion of the human body to retain the band member in selected position thereon, an electrically conductive metallic contact pad formation carried by the band member to be held thereby in contact with the skin of the user, and flexible electrical conductors coupled to and extending from the pad formation for releasable connection with the shock generator carried by the case.

* * * * *